US005501403A

United States Patent [19]

van Vooren

[11] Patent Number: 5,501,403

[45] Date of Patent: Mar. 26, 1996

[54] SPREADING APPARATUS AND A DISTRIBUTION CHAMBER THEREFOR

[75] Inventor: Cornelis B. van Vooren, Almelo, Netherlands

[73] Assignee: Schmidt Holding Europe GmbH, Netherlands

[21] Appl. No.: 252,956

[22] Filed: Jun. 2, 1994

[30] Foreign Application Priority Data

Jun. 3, 1993 [NL] Netherlands ..... 9300955

[51] Int. Cl.[6] ..... A01C 23/00

[52] U.S. Cl. ..... 239/662; 239/674; 239/676; 239/684; 239/687

[58] Field of Search ..... 239/662, 670, 239/672, 674, 676, 677, 681, 684, 685, 687, 650, 127, 581.1; 137/875, 876, 147, 151, 123, 874

[56] References Cited

U.S. PATENT DOCUMENTS

| | | | |
|---|---|---|---|
| 2,625,952 | 1/1953 | Eide et al. | 137/874 X |
| 3,420,451 | 1/1969 | Kahlbacher | 239/677 X |
| 3,831,818 | 8/1974 | Dumont | 222/185 X |
| 3,848,635 | 11/1974 | Scheffler, Jr. | 239/127 X |
| 4,108,206 | 8/1978 | Mountain | 137/876 X |
| 4,156,439 | 5/1979 | Jeffries et al. | 137/875 X |
| 4,511,284 | 4/1985 | Sterner | 239/654 X |
| 4,588,127 | 5/1986 | Ehrat | 239/662 X |
| 4,812,082 | 3/1989 | Cooper | 137/887 X |
| 4,886,208 | 12/1989 | Strand | 239/662 X |
| 5,069,392 | 12/1991 | Wise et al. | 239/677 X |
| 5,186,396 | 2/1993 | Wise et al. . | |
| 5,242,120 | 9/1993 | Barber et al. | 239/662 X |
| 5,333,795 | 8/1994 | Jessen | 239/687 X |

FOREIGN PATENT DOCUMENTS

| | | | |
|---|---|---|---|
| 4077 | 5/1905 | France | 137/876 |
| 374241 | 6/1907 | France . | |
| 2378132 | 9/1978 | France | 239/662 |
| 2524028 | 9/1983 | France . | |
| 2661201 | 10/1991 | France . | |
| 3712452 | 11/1988 | Germany | 239/662 |
| 516050 | 1/1972 | Switzerland | 239/662 |
| 1355151 | 11/1987 | U.S.S.R. | 239/662 |

*Primary Examiner*—Andres Kashnikow
*Assistant Examiner*—Lesley D. Morris
*Attorney, Agent, or Firm*—Webb Ziesenheim Bruening Logsdon Orkin & Hanson

[57] ABSTRACT

The invention relates to a spreading apparatus comprising a container for spreadable granular material which is provided with an outlet which is closable with a controllable metering valve and which connects to spreader members, a reservoir for liquid wetting agent whereof an outlet provided with a pump is connected via a feed conduit for wetting agent to the spreader members, wherein the feed conduit forms a siphon which extends above the filling level of the reservoir for liquid wetting agent and is provided with venting means and connects via an open feed conduit end to the spreader members, and to a distribution chamber therefor.

8 Claims, 5 Drawing Sheets

SPREADING APPARATUS AND A DISTRIBUTION CHAMBER THEREFOR

FIELD OF THE INVENTION

The present invention relates to a spreading apparatus and to a distribution chamber therefor. The present invention relates more particularly to a spreading apparatus wherein granular material for spreading is made wet with a liquid wetting agent.

BACKGROUND OF THE INVENTION

The spreading of wettened spreadable material has the advantage that the wettened spreadable material adheres better and remains adhered to the place where it falls. It is thus possible for preventive spreading of a road surface to be carried out with wettened road salt, wherein the wettened road salt adheres to the road surface and is not blown away, while the forecast ice formation only occurs some time later.

In spreading with wettened material it is essential that the supply of liquid wetting agent is adapted to the variable metering of spreadable granular material. In spreading of road salt the delivery is thus dependent on the speed of the vehicle on which the spreading apparatus is placed, which speed is measured with a measuring wheel which also serves to energize the hydraulic system.

According to known prior art liquid wetting agent is supplied via a pump, wherein the flow rate of the pump depends on the delivery or metering of the spreadable granular material. In order to avoid the reservoir of liquid wetting agent draining through the pump it is necessary for the feed conduit which supplies wetting agent from the pump to the spreader members to be provided with a biased non-return valve which must have for instance an additional seat pressure of about 1.5 bar.

SUMMARY OF THE INVENTION

The invention has for its object to provide a spreading apparatus not having the above stated drawback, which spreading apparatus is characterized for this purpose in that it comprises a container for spreadable granular material which is provided with an outlet which is closable with a controllable metering valve and which connects to a spreader member, a reservoir for liquid wetting agent whereof an outlet provided with a pump is connected via a feed conduit for wetting agent to the spreader member, wherein the feed conduit forms a siphon which extends above the filling level of the reservoir for liquid wetting agent and is provided with venting means and connects via an open feed conduit end to the spreader member.

Because the feed conduit is embodied as a siphon which extends above the filling level of the reservoir, the pump, driven variably subject to the metering speed of spreadable material, only has to pump wetting agent up to this constant rise height, whereafter the wetting agent can run out freely. In order to exclude siphoning the siphon must herein be provided with venting means for the feed conduit.

The pump flow rate herein depends on the metering of spreadable material, i.e. depends on the position of the controllable metering valve. For optimum switching of the pump subject to the position of the controllable metering valve a relatively expensive hydraulic valve system is required. This relatively expensive valve system can be dispensed with if the pump is drivable with a variable but sufficient flow rate and the feed conduit is provided with a controllable distribution chamber which, depending on the position of the metering valve, distributes the wetting agent over the feed conduit and over a return conduit which connects onto the reservoir for wetting agent.

In this case the pump is driven with a variable but sufficient flow rate and, using a distributor valve, that volume of wetting agent is separated off which is necessary depending on the metering of spreadable material. At maximum as much wetting agent is supplied as is necessary for a maximum flow rate of spreadable material and at minimum no wetting agent is delivered and all the wetting agent is carried back via the return conduit to the reservoir.

If the distribution chamber is located at a level above the filling level of the reservoir the wetting agent can be raised with the pump to a constant rise height, irrespective of the distribution over feed conduit and return conduit, in which case both of these conduits can in principle each be empty.

For optimum functioning of the distribution chamber, the distribution chamber comprises means for distributing the supplied volume of wetting agent, subject to the position of the metering valve, into a volume part for the feed conduit and a volume part for the return conduit.

According to a preferred embodiment the distribution chamber comprises a chamber with an inlet connected to the feed conduit and an adjustable partition wall which extends over the inlet aperture and adjustably divides the chamber into a chamber portion which connects to the feed conduit and a chamber portion which connects to the return conduit.

Finally, the invention relates to a distribution chamber for a spreading apparatus of the type stated in the preamble.

Mentioned and other features of the spreading apparatus and the distribution chamber according to the invention will be further elucidated hereinafter in the light of a number of embodiments, which are only given by way of example and wherein reference is made to the annexed drawings.

DETAILED DESCRIPTION OF THE INVENTION

Figure 1:
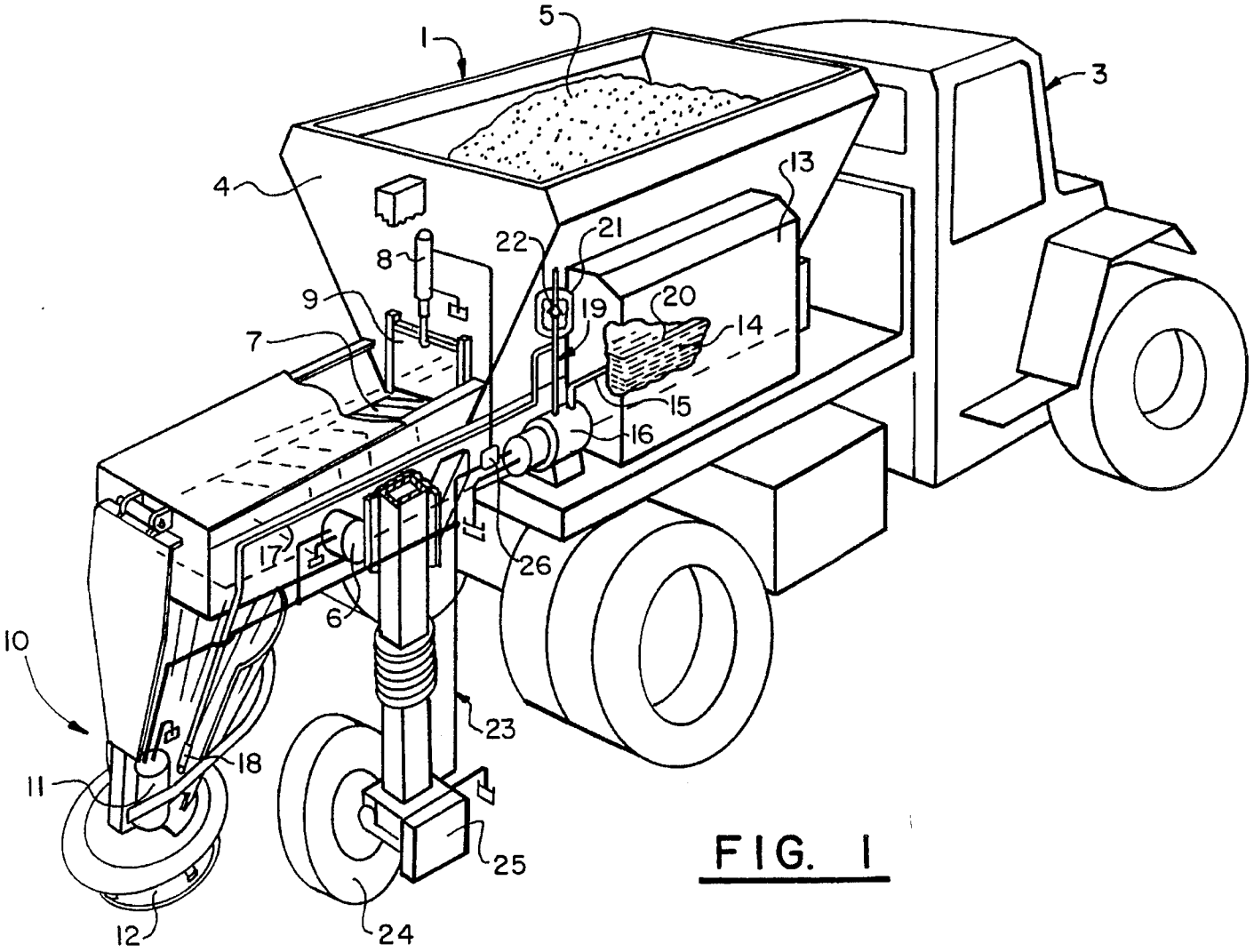
FIG. 1 and FIG. 2 each show a perspective, partly broken away view of spreading apparatus according to the invention.

FIG. 1 shows a spreading apparatus 1 according to the invention which is placed on a vehicle 3. The spreading apparatus comprises a container 4 for spreadable granular material 5, such as road salt. Container 4 is provided on the underside with a conveyor belt 7 which is driven with a motor 6 and with which the spreadable material, dosed with a metering valve 9 controllable via a cylinder 8, is fed to at least one spreader member 10 which is provided with a spreader disc 12 driven with a motor 11.

The spreading apparatus 1 according to the invention is also provided with at least one reservoir 13 for liquid wetting agent 14. Reservoir 13 is connected via an outlet 15 to a pump 16 which supplies the wetting agent via a feed conduit 17 to a nozzle 18 or distributing pipe with which the spreadable material arriving in the spreader member 10 is made wet. Feed conduit 17 is provided with a siphon 19 which extends above the filling level 20 of reservoir 13 and protruding above the siphon is a venting unit 21 which is optionally provided with a non-return valve 22.

The hydraulic system, generally designated with reference numeral 23, is energized with a castor 24 which rolls over the ground and drives a hydraulic pump 25. The hydraulic system is thus brought to pressure, wherein the pump 16 is driven via the distribution system 26 with an adjustable pump flow rate subject to the position of metering valve 9 and thus of its cylinder 8. Depending on the metering speed of the spreadable material 5 this latter can thus be made wet in relatively equal measure making use of pump 16 which functions at an adjustable pump flow rate.

Figure 2:
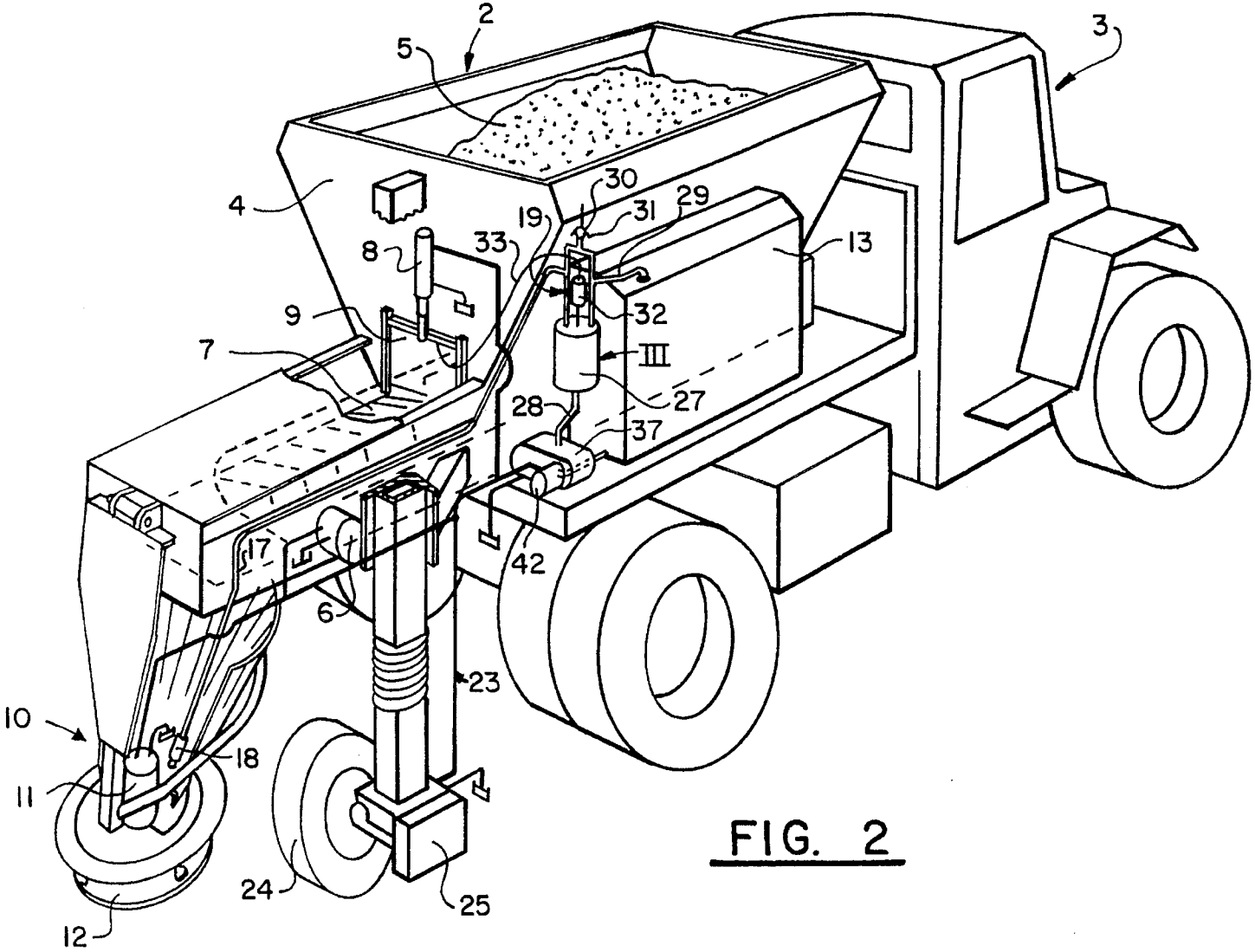

FIG. 2 shows a spreading apparatus 2 according to the invention which has a simpler hydraulic system compared to spreading apparatus 1, since in this case the pump 37 is driven at a constant pump flow rate because a constant hydraulic quantity is supplied by the pump motor 42.

In this case the feed conduit 17 is provided in its siphon 19 with a distribution chamber 27 which on one side is connected via the riser pipe 28 to the pump 37 and on the other side is provided with two conduits, the feed conduit 17 which ends in the nozzle 18, and a return conduit 29 which carries excess pumped wetting agent back to reservoir 13. The feed conduit 17 and the return conduit 29 are both connected to a venting member 31 provided with a non-return valve 30. Distribution chamber 27 is provided with an adjusting member 32 which is coupled via a connection 33 to the metering valve 9 and with which, depending on the position of metering valve 9, a distribution is made between wetting agent which is drained via feed conduit 17 and wetting agent which is returned via return conduit 29. The connection 33 between the adjusting member 32 and the metering valve 9 can take place mechanically (system of rods), electrically (electric motor) as well as hydraulically (hydraulic motor).

Figure 3:
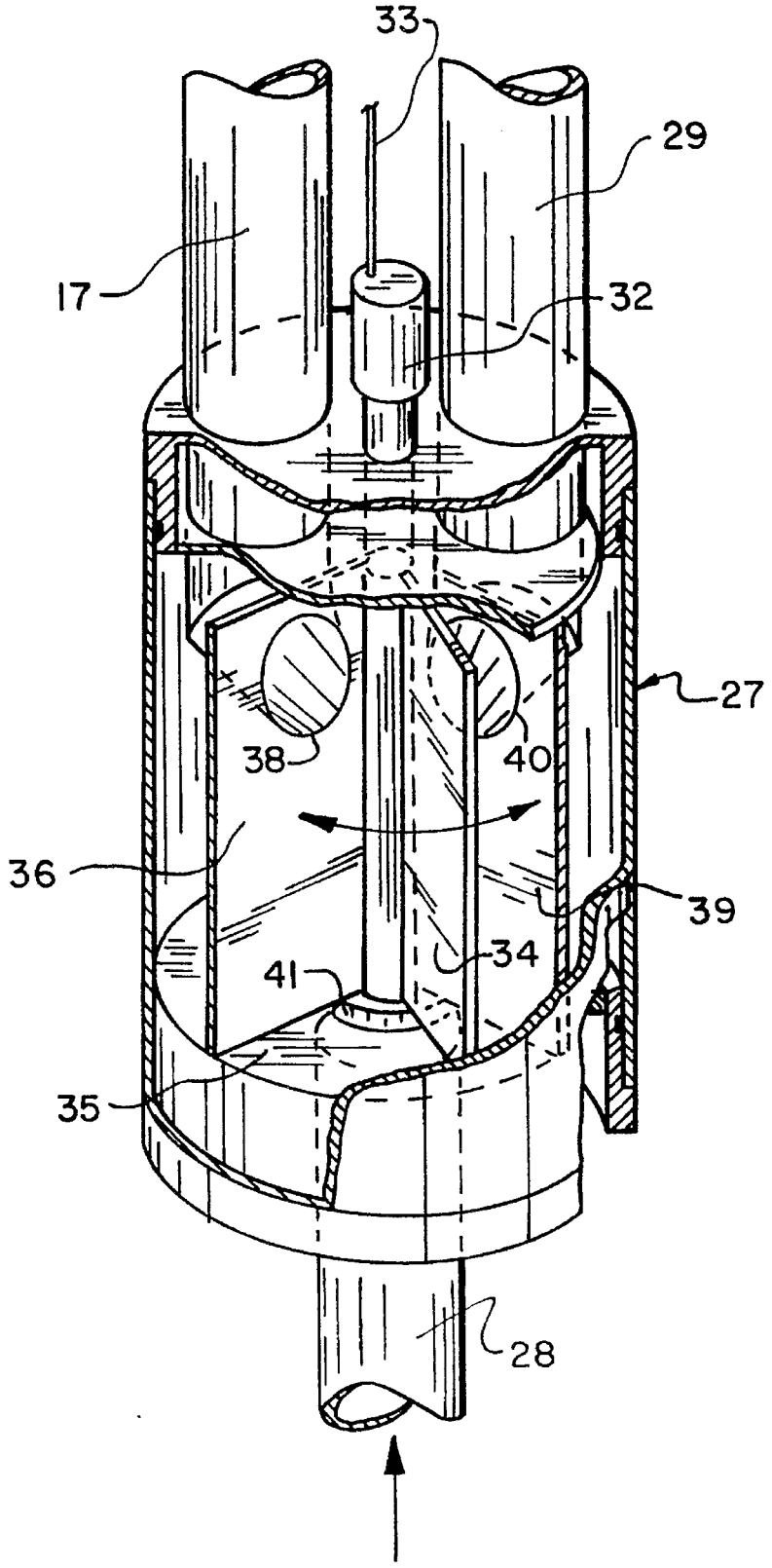
FIG. 3 shows on a larger scale detail III of FIG. 2.

As shown in FIG. 3, the distribution chamber 27 comprises means 32 and 34 for distributing the volume of wetting agent supplied via the riser pipe 28, subject to the position of the motoring valve 9, in a volume part than is drained via the feed conduit 17 to the nozzle 18 and a volume part that is carried back via the return conduit 29 to the reservoir 13. In this case the distribution means comprises in addition to the adjusting member 32 a rotatable partition wall 34 which makes a division in a chamber 35 between a chamber portion 36 which connects via an outlet 38 to the feed conduit 17 and a chamber portion 39 which connects via an outlet 40 to the return conduit 29. Partition wall 34 herein extends over an inlet aperture 41 of riser pipe 28. Obstruction of wetting agent is herein impossible because the surface area of the inlet aperture 41 through which agent flows is smaller than that of both aperture 38 and aperture 40.

Figure 4:
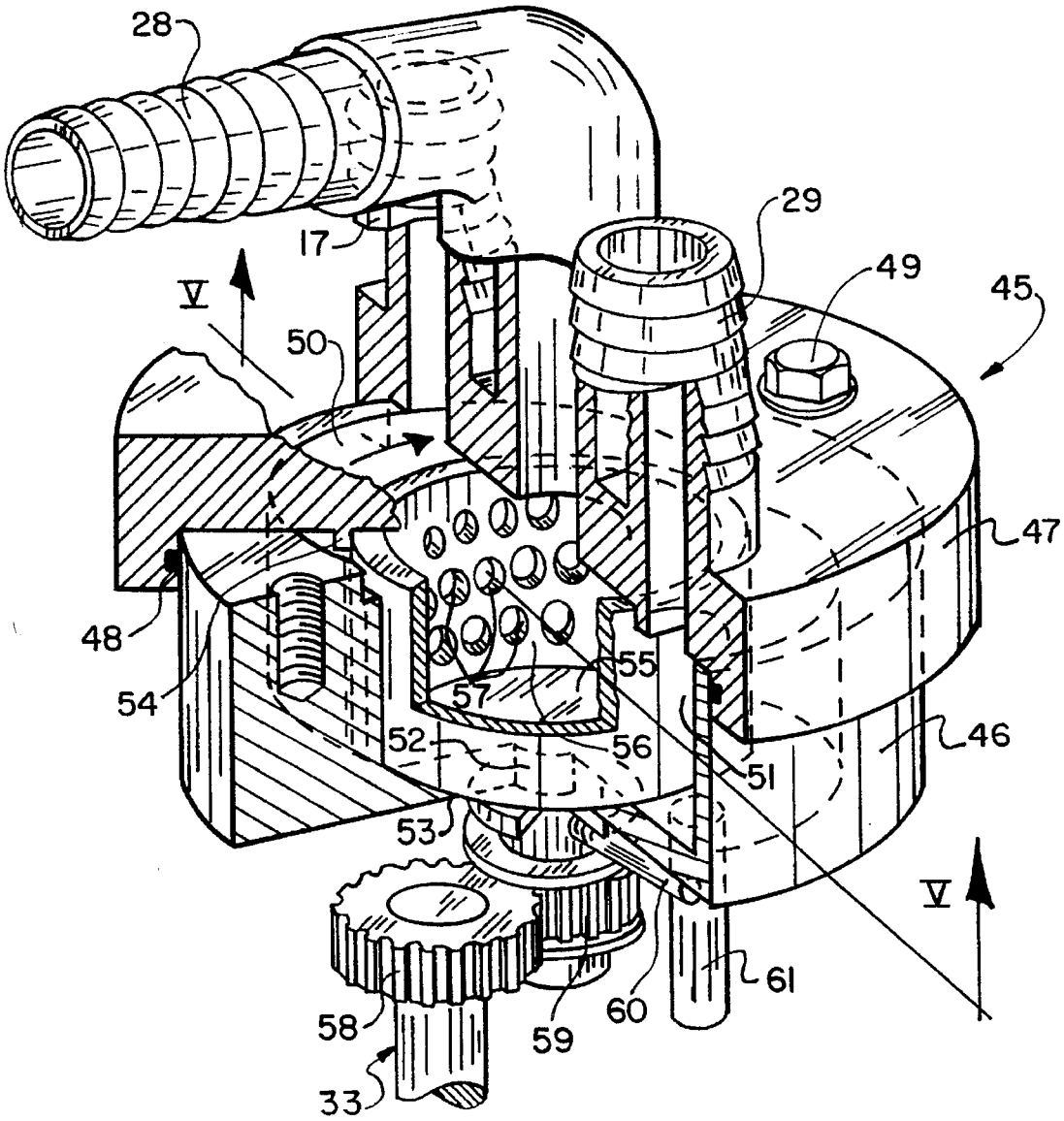
FIG. 4 Shows another distribution chamber according to the invention.
Figure 5:
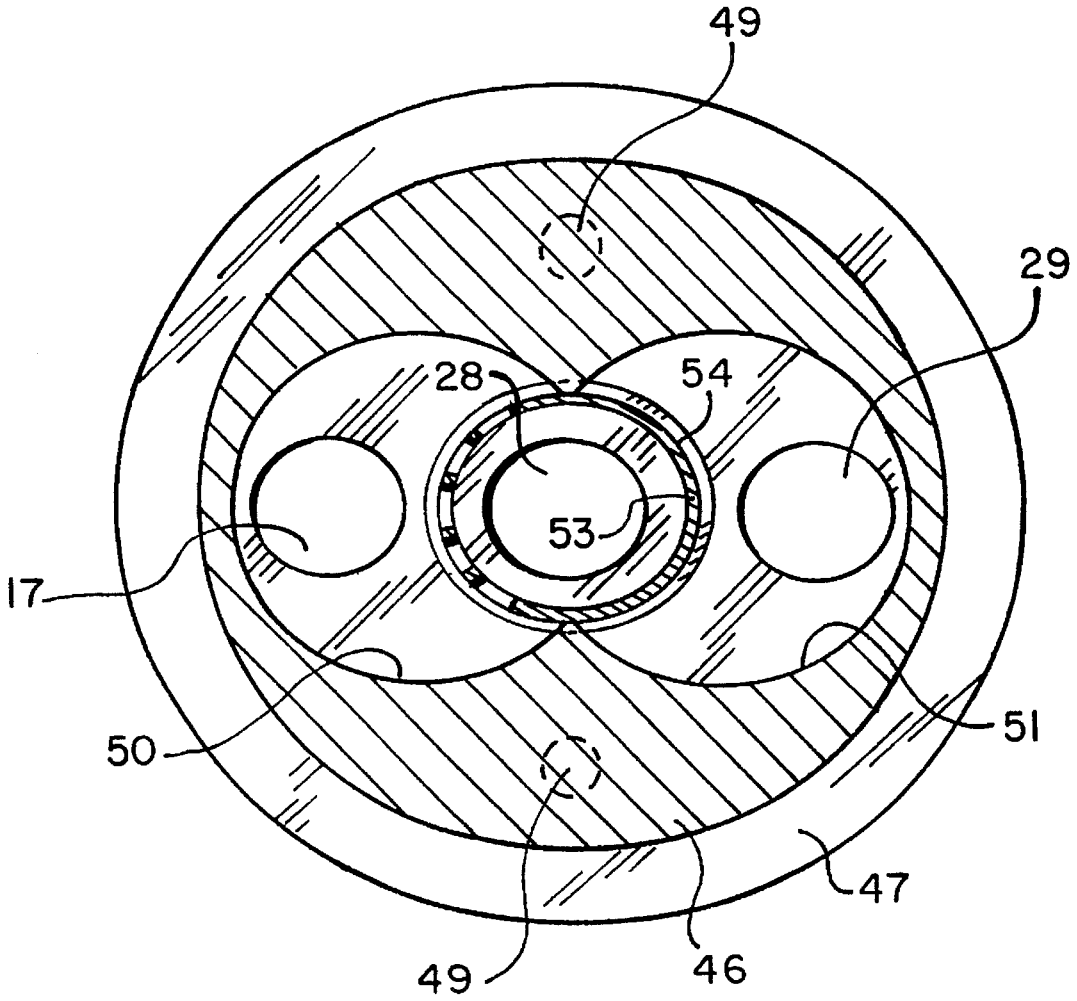
FIG. 5 shows a bottom view along the lime V—V in FIG. 4.

FIGS. 4 and 5 show a distribution chamber 45 according to the invention which is constructed from a chamber base 46 and a chamber cover 47 which is fastened with the bolts 49 in sealing manner with a sealing ring 48.

The chamber base 46 comprises a feed chamber 50 connected to the reed conduit 17 and a return chamber 51 connected to the return conduit 29. Chambers 50 and 51 have a cylindrical form and a distribution dish 53 is arranged as a partition at the division between both chambers 50 and 51, which dish is rotatable in the distribution chamber 45 with the shaft 52 and which is guided in the chamber base 46 and a peripheral edge 54 of chamber cover 47. The distribution dish 53 forms a distribution chamber 55 which is connected to the riser pipe 28.

A peripheral portion of the standing wall 56 of the distribution dish 53 is further provided with outlets 57 which, depending on the rotational position of the distribution dish, can be connected for liquid communication to the feed chamber 50 or the return chamber 51.

The position of the distribution dish 53 in the distribution chamber 45 is adjustable with the connection 33 which comprises a pinion 58 which engages with a toothed wheel 59 arranged on shaft 52. The latter is further provided with a pin 60 which co-acts with a stop 51 fixed on chamber base 46 so that the rotation of the distribution dish 53 is limited to practically 360°.

Through adjustment with the means 33 of the position of the distribution dish, and therewith its outlets 57, wetting agent is fed via the riser pipe 28 distributed over both chambers 50 and 51 or only one of both chambers, whereby, depending on the position of the metering valve, wetting agent is drained to the spreader disc 12 or returned to the reservoir 13.

Although the spreading apparatus embodiments according to the invention are only described for application in spreading of road salt, it will be apparent that such a spreading apparatus can also be used for spreading other wettable spreadable material such as fertilizer and the like.

I claim:

1. A spreading apparatus comprising a controllable metering valve; a spreader member; a container for spreadable granular material, wherein the container is provided with an outlet which is closable with the controllable metering valve and which connects to the spreader member; a feed conduit for wetting agent; and a reservoir for liquid wetting agent, the reservoir including an outlet provided with a pump connected to the feed conduit for wetting agent, wherein the feed conduit includes a siphon which extends above a filling level of the reservoir for liquid wetting agent and is provided with venting means and wherein the feed conduit connects via an open feed conduit end to the spreader member.

2. The spreading apparatus as claimed in claim 1, further including a return conduit, wherein the pump has a variable flow rate and the feed conduit includes a controllable distribution chamber which, depending on a position of the metering valve, distributes the wetting agent to at least one of the feed conduit and the return conduit, wherein the return conduit connects onto the reservoir for wetting agent.

3. The spreading apparatus as claimed in claim 2, wherein the distribution chamber is located at a level above the filling level of the reservoir.

4. The spreading apparatus as claimed in claim 2, wherein the distribution chamber comprises means for distributing the wetting agent, subject to the position of the metering valve, in a volume part for the feed conduit and a volume part for the return conduit.

5. The spreading apparatus as claimed in claim 4, wherein the distributing means comprises a chamber having an inlet aperture and an adjustable partition wall which extends over the inlet aperture and adjustably divides the chamber into a chamber portion which connects to the feed conduit and a chamber portion which connects to the return conduit.

6. The spreading apparatus as claimed in claim 4, wherein the distributing means comprises a feed chamber connected to the feed conduit, a return chamber connected to the return conduit, and a distribution dish which is provided with outlets and is rotatable in the distribution chamber and which forms a division between the feed chamber and the return chamber.

7. A distribution chamber comprising means for distributing wetting agent, subject to a position of a metering valve, in a volume part for a feed conduit and a volume part for a return conduit, wherein the distributing means includes an inlet aperture and a rotatable partition wall which extends over the inlet aperture and divides the distribution chamber into a first chamber portion having a first outlet connected to the feed conduit and a second chamber portion having a second outlet connected to the return conduit, wherein a surface area of the inlet aperture is less than a surface area of each of the first and second outlets.

8. A distribution chamber comprising means for distributing wetting agent, subject to a position of a metering valve, in a volume part for a feed conduit and a volume part for a return conduit, wherein the distributing means includes a feed chamber connected to the feed conduit, a return chamber connected to the return conduit, and a distribution dish which is provided with outlets and is rotatable in the distribution chamber and which forms a division between the feed chamber and the return chamber.

* * * * *